US009055778B1

(12) United States Patent
Kelley et al.

(10) Patent No.: US 9,055,778 B1
(45) Date of Patent: Jun. 16, 2015

(54) ARTICLE OF FOOTWEAR WITH INTERACTIVE SYSTEM

(71) Applicant: Skechers U.S.A., Inc. II, Manhattan Beach, CA (US)

(72) Inventors: Scott Kelley, Torrance, CA (US); Sam Chou, Los Angeles, CA (US)

(73) Assignee: SKECHERS U.S.A., INC. II, Manhattan Beach, CA (US)

( * ) Notice: Subject to any disclaimer, the term of this patent is extended or adjusted under 35 U.S.C. 154(b) by 0 days.

(21) Appl. No.: 14/472,214

(22) Filed: Aug. 28, 2014

(51) Int. Cl.
*G09B 7/00* (2006.01)
*A43B 3/00* (2006.01)

(52) U.S. Cl.
CPC ..... *A43B 3/0005* (2013.01); *A43B 3/0021* (2013.01); *A43B 3/001* (2013.01)

(58) Field of Classification Search
USPC ..... 434/247, 255, 308, 321, 322, 323, 335, 434/362; 446/26, 27, 28, 71, 81; 36/136, 36/137
See application file for complete search history.

(56) References Cited

U.S. PATENT DOCUMENTS

| | | | | |
|---|---|---|---|---|
| 4,207,087 | A | 6/1980 | Morrison et al. | |
| 4,466,204 | A * | 8/1984 | Wu | 36/132 |
| 4,510,704 | A * | 4/1985 | Johnson | 36/136 |
| 5,343,445 | A * | 8/1994 | Cherdak | 368/10 |
| 5,483,759 | A | 1/1996 | Silverman | |
| 5,672,107 | A * | 9/1997 | Clayman | 463/36 |
| 5,765,300 | A * | 6/1998 | Kianka | 36/139 |
| 6,122,340 | A * | 9/2000 | Darley et al. | 377/24.2 |
| 6,213,872 | B1 * | 4/2001 | Harada et al. | 463/7 |
| 6,278,378 | B1 * | 8/2001 | Feiner et al. | 340/815.45 |
| 6,302,789 | B2 * | 10/2001 | Harada et al. | 463/7 |
| 6,499,857 | B1 * | 12/2002 | Lumley | 362/154 |
| 7,096,607 | B2 | 8/2006 | Guzman | |
| 7,114,822 | B2 | 10/2006 | Guzman | |
| 7,178,929 | B2 | 2/2007 | Guzman | |
| 7,254,910 | B2 | 8/2007 | Guzman | |
| 7,299,034 | B2 * | 11/2007 | Kates | 455/415 |
| 7,329,019 | B2 | 2/2008 | Cheung | |
| 7,494,237 | B1 | 2/2009 | Cheung | |
| 7,631,382 | B2 * | 12/2009 | DiBenedetto et al. | 12/142 P |
| 7,698,101 | B2 * | 4/2010 | Alten et al. | 702/182 |
| 7,748,144 | B2 | 7/2010 | Denfeld | |
| 7,866,066 | B2 * | 1/2011 | Forbes | 36/137 |
| 7,924,152 | B1 * | 4/2011 | Daniel | 340/539.13 |
| 8,087,801 | B2 | 1/2012 | Tseng | |
| 8,103,802 | B2 * | 1/2012 | Lay et al. | 710/2 |
| 8,461,979 | B2 * | 6/2013 | Case, Jr. | 340/539.1 |
| 8,469,535 | B2 | 6/2013 | Guzman | |
| 8,641,220 | B1 | 2/2014 | Lin | |
| 8,650,764 | B2 | 2/2014 | Hartford et al. | |
| 8,702,430 | B2 * | 4/2014 | Dibenedetto et al. | 434/247 |
| 2004/0172856 | A1 | 9/2004 | Horchler et al. | |
| 2005/0183294 | A1 | 8/2005 | Guzman | |

(Continued)

*Primary Examiner* — Kurt Fernstrom
(74) *Attorney, Agent, or Firm* — Marshall A. Lerner; Marvin H. Kleinberg; Kleinberg & Lerner, LLP

(57) ABSTRACT

The present invention is related to an article of footwear, namely an interactive activity integrated into the article of footwear. The interactive activity may be operated when the article of footwear is either in motion or stationary. The interactive activity instructs the user to respond. Upon a correct or incorrect response, the interactive activity will provide either further instruction or provide a signal that informs the user of the propriety of their response. The interactive activity may be a music tutorial, a game, or an educational tool.

18 Claims, 9 Drawing Sheets

(56) References Cited

U.S. PATENT DOCUMENTS

| | | | | |
|---|---|---|---|---|
| 2005/0223603 | A1 | 10/2005 | Hsieh et al. | |
| 2005/0227811 | A1 * | 10/2005 | Shum et al. | 482/1 |
| 2010/0035688 | A1 | 2/2010 | Picunko | |
| 2010/0223815 | A1 | 9/2010 | McGarity | |
| 2013/0031808 | A1 | 2/2013 | Holness | |
| 2013/0033378 | A1 | 2/2013 | Donovan et al. | |
| 2013/0276334 | A1 | 10/2013 | Bellone et al. | |

* cited by examiner

FIG. 4A
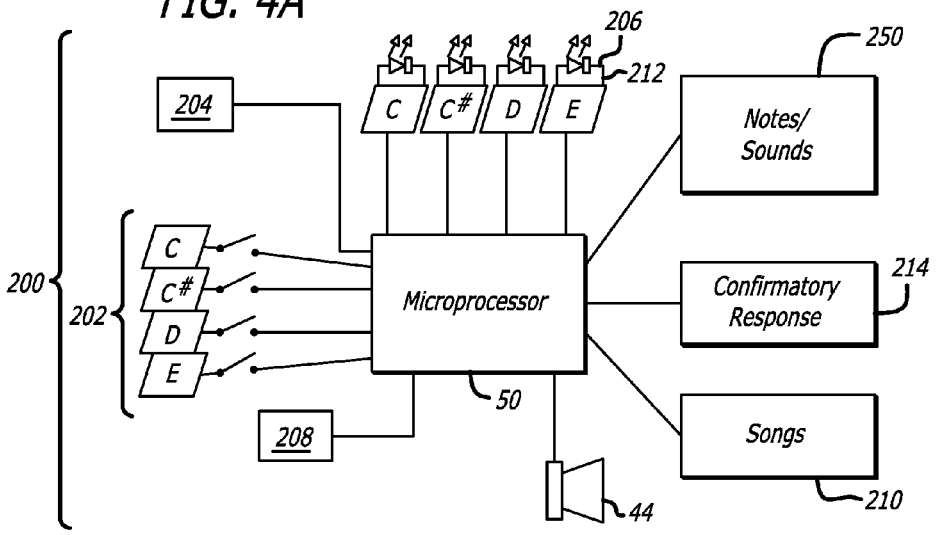
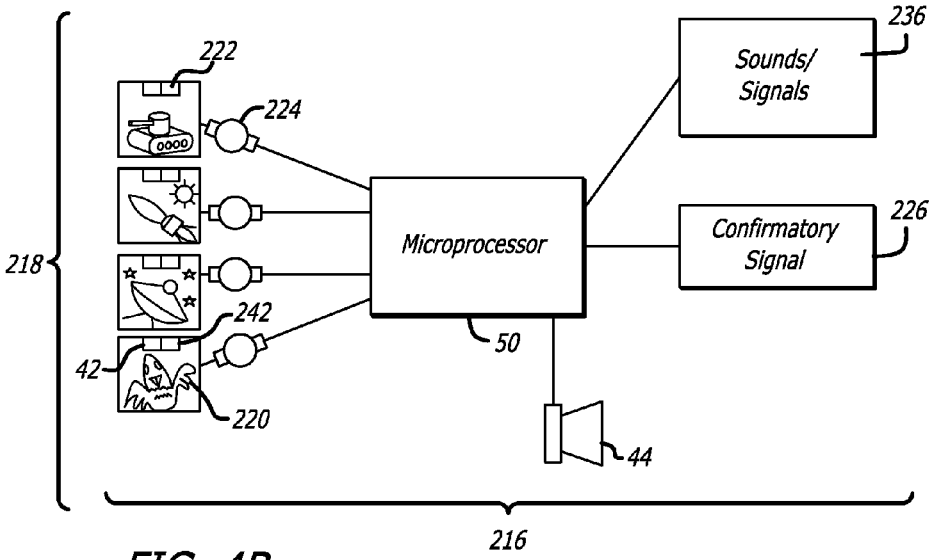
FIG. 4B

ARTICLE OF FOOTWEAR WITH INTERACTIVE SYSTEM

FIELD OF THE INVENTION

The present invention relates to footwear, namely an article of footwear with an integrated interactive system.

BACKGROUND OF THE INVENTION

Lights, electronic displays, or sounds have all been previously combined with articles of footwear. Some of these features are activated by a wearer's movement of the wearer's own foot and not by any manual operation or mental participation of the features by the wearer, as shown in U.S. Pat. Nos. 7,096,607, 7,494,237, 8,641,220, 8,469,535, and 8,087,801, and U.S. patent application Ser. Nos. 10/782,587, 12/514,261, and 13/454,460. Other articles of footwear lack features where a user can actively engage these features in a thought-provoking activity. Many of these added features to articles of footwear may be simply for decoration, playing sounds, playing voices or playing music. Examples of such prior art are U.S. Pat. Nos. 7,114,822, 7,178,929, 7,329,019, 7,494,237, 7,866,066, 8,650,764, 8,769,836, and 8,641,220, and U.S. patent application Ser. Nos. 10/443,485, 10/782,587, 10/885,599, and 13/198,136.

One shoe as presented in U.S. Pat. No. 7,748,144 is a shoe shaped as a toy car. The shoe has buttons which initiates car noises and flashes attached lights. A wearer of the shoe has minimal interaction with this shoe as the features are only part of a toy and the shoe provides little to no instruction to the wearer as to which features should be operated at any given time or specified manner. The wearer is only relegated to pushing buttons in any order, and will ultimately become bored by the lack of interactive engagement with these shoe components.

Another shoe has a maze with a moveable ball where a wearer attempts to direct the ball through fixed walls of the maze. The wearer controls the ball by either moving their foot while wearing the shoe or by taking off the shoe and moving the shoe manually. Refer to U.S. patent application Ser. No. 13/454,460. Once the ball reaches the end of the maze, the shoe lights up and emits sounds. This shoe requires either the wearer to focus on the motor control of their foot or the physical movement of the shoe. The shoe only provides the wearer direction with the fixed walls of the maze. The walls of the maze cannot be altered or randomly rearranged. The wearer is confined to follow the same path each time. The lights and sounds on the shoe are configured to only light up when the ball reaches a certain point on the maze. The shoe does not require the wearer's understanding, logic, ability to retain information, and mental acuity.

Electronic games associated with shoes are primarily related to a wearer of the shoe moving around their foot. There is an absence of interactive activities that are integrated with shoes in which the activity does not require a wearer of the interactive activity to move around the user's own foot. At times, it is also better that the child remains in one position and still be entertained, rather than moving around or kicking their feet. Also, there are no interactive activities integrated on footwear that allow the wearer to control varying signal modes, e.g. turning the sound, lights, or vibration mode on or off, that are used to instruct the wearer in how the wearer can participate with the interactive system. Such features also allow the game to be played in a manner that does not disturb others. Furthermore, there have been no articles of footwear with an electronic game that is programmed to interact with the user such that the user is prompted to think about the game's instructions and act in accordance with the game's instruction.

Keeping children engaged in activities is a perpetually daunting task for parents, teachers, and caretakers. There is a need for having thought provoking and educational activities that are conveniently available to children at all times and do not require any additional transport of a toy or item that is physically separate from a child's everyday apparel. Transport of additional toys or items may result in the item being lost or stolen. The convenience of a portable interactive game that is integrated into a child's shoe enables children to have easy access to activities that develop their minds at any time throughout the day.

INVENTION SUMMARY

The present invention is related to an article of footwear, and namely an interactive activity integrated into the article of the footwear. The interactive activity may be operated when the article of footwear is not in motion. The interactive activity instructs the user to respond by operating receivers. When either a correct or incorrect response is inputted, the interactive activity may provide further instruction or may signal the user with regards to the propriety of their response or a combination thereof. The signals may be emitted in the form of lights, sounds, or vibration such that the user may understand the instructions and operate the interactive activity accordingly. The interactive activity may be, but is not limited to, a music tutorial device, a targeting game, or an educational device.

The present invention is related to the construction of an article of footwear configured with an integrated interactive activity system. The construction may include multiple layers of material surrounding the user's foot such that the user is provided comfort while operating the integrated interactive activity system. The article of footwear may be in motion or stationary while the user is operating the integrated interactive activity system.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

BRIEF DESCRIPTION OF THE DRAWINGS

These and other features of this invention will be best understood by reference to the following detailed description of a preferred embodiment of the invention, taken in conjunction with the accompanying drawings, in which.

DETAILED DESCRIPTION OF THE PREFERRED EMBODIMENTS

Figure 1:
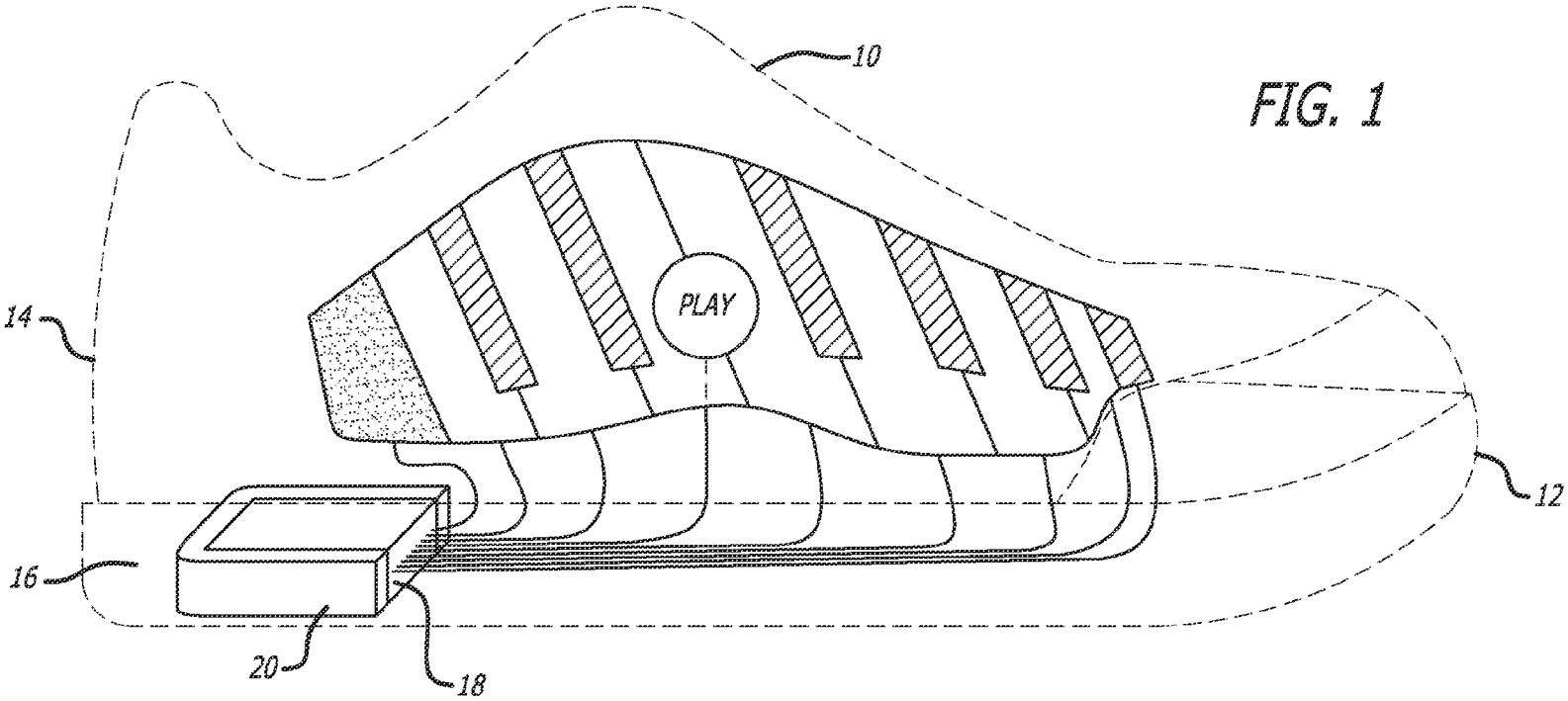
FIG. 1 is a perspective view of the medial side of a shoe having an interactive system.

FIG. 1 is an exemplary embodiment of a shoe 10, which in this case, may be an athletic shoe. The shoe also may be any type such as a casual shoe, dress shoe, boot, or specialized sport shoe (e.g. soccer, baseball, basketball). The shoe 10 as shown at least comprises a sole 12 which is attached to an upper 14. The shoe 10 is shown for one foot. It should be understood that the following discussion may equally apply to the shoe for the other foot. The present shoe 10 is shown with solid lines for some components and phantom lines for others.

The shoe 10 may also have one or more compartments 16 configured to house at least a portion of the components of an interactive system 18. In this embodiment, the compartment 16 is situated within the sole 12. The sole 12 may be constructed of materials commonly used by those with an ordinary skill in the art such as rubber, vulcanized rubber, thermoplastic rubber, polyurethane (PU), ethyl vinyl acetate (EVA) or thermoplastic elastomers. The compartment 16 within the sole 12 may be a hollow space within the sole 12. The compartment 16 may be configured to have walls 20 that both create the hollow space and may provide support and protection from the use of the shoe 10. The walls 20 may be constructed of the same or different material as the sole 12. In a preferred embodiment, the walls 20 may be constructed of a more rigid material than the sole 12. The walls 20 may also be constructed in a manner that absorbs pressure or shock that may be exerted on the sole 12 by the user.

Figure 2:
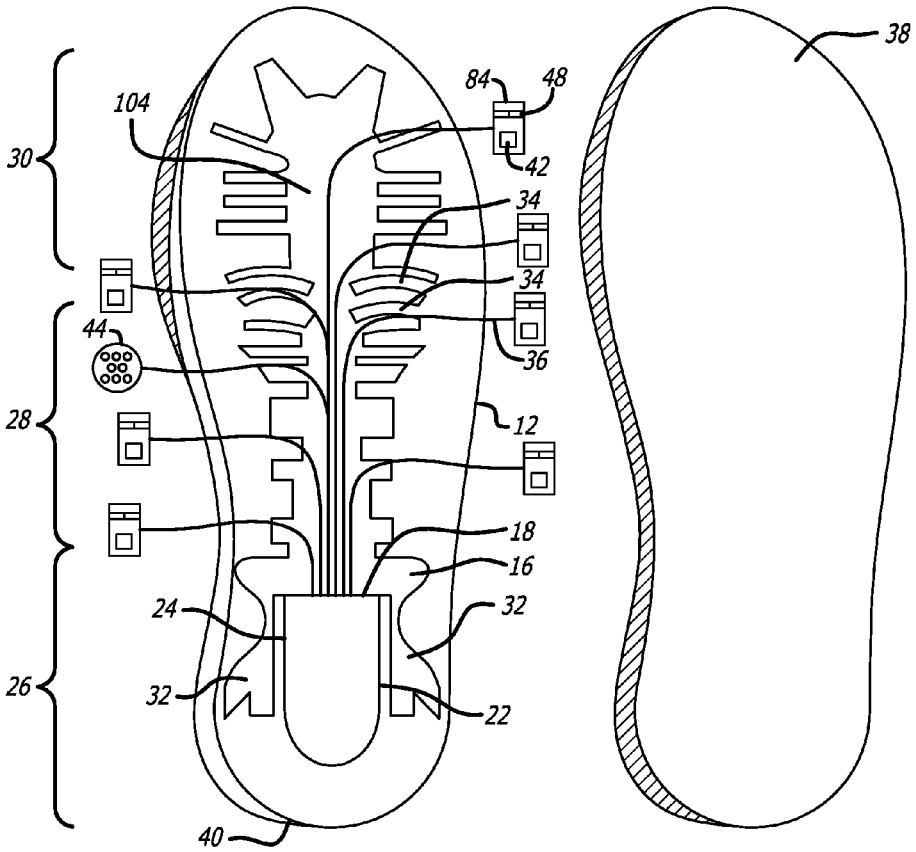
FIG. 2 is a top view of the interior of a sole having a portion of the interactive system.

In the exemplary embodiment in FIG. 2 of the sole 12 of the shoe 10, the compartment 16 may have securing walls 22 in the heel area 26. The securing walls 22 may surround a part or substantially all of an integrated circuit 24. The interactive system may have one or more integrated circuits. The integrated circuit 24 may be located in other areas of the shoe such as the midfoot area 28 or the forefoot area 30 of the sole 12 or the heel counter or the upper. The securing walls 22 may hold the integrated circuit 24 securely in position such that the integrated circuit 24 does not move around in the sole 12. The securing walls 22 may also provide support from pressure and shock. The securing walls 22 may be configured apart from the interior walls of the sole 12 to create spaces that provide a buffer zone 32. Buffer zones reduce any force that may be exerted upon the components of the interactive system 18. A plurality of spaced walls 34 may provide the necessary support and comfort in wearing the shoe. The area between the spaced walls 34 may promote flexion in the sole 12 that is necessary for natural walking or running. Further to the space between the spaced walls 34, the area may absorb force on the interactive system 18 by serving as a buffer zone 32.

The compartment 16 between the spaced walls 34 may be used to house portions of the interactive system 18. In this exemplary embodiment, the space may also be used as a channel for at least one wire 36 attached to the integrated circuit 24. The wire 36 may be configured to reach the upper 14 without entering the area of the shoe 10 that receives the foot. An insole 38 or sock liner may be placed over the sole 12. The wire 36 as shown in FIG. 2 may come up from the sole between the insole 38 and the interior frame 40 of the sole 12.

Interactive System

Figure 3:
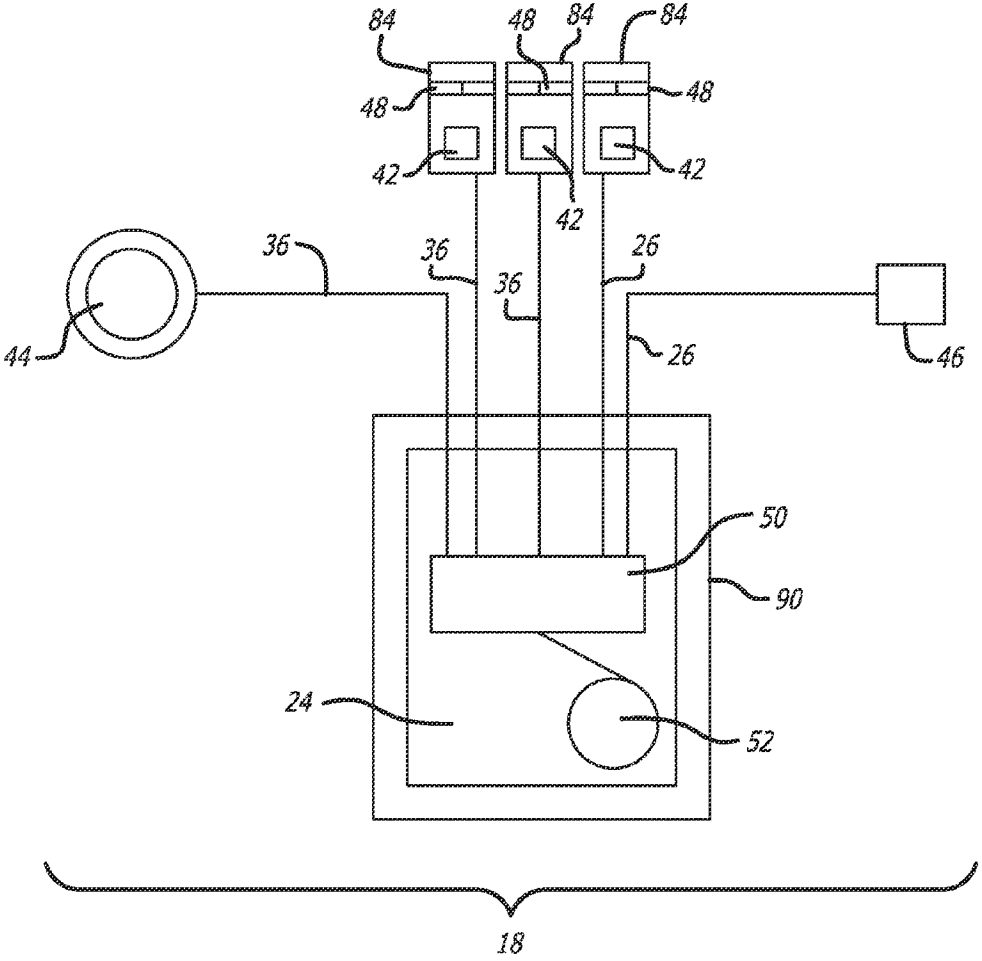
FIG. 3 is schematic of the interactive system.

Generally, the interactive system 18 may comprise an integrated circuit 24 as shown in FIG. 3. The integrated circuit 24 may be a printed integrated circuit. The integrated circuit 24 may be programmed using in-circuit serial programming or through a printed circuit programming language such as Assembler, Machine code, Basic, and C. The integrated circuit 24 may be enclosed in a rigid plastic shell 90. A battery 52 which may be used to supply power to the integrated circuit may also be enclosed within the rigid plastic shell 90. The plastic shell 90 may be filled with a hard-set acrylic or epoxy resin for protection and stability of the integrated circuit 24. The sole 12 may have securing walls 22 molded as part of the interior surface of the sole 12 so as to fit the plastic shell 90 that encases the integrated circuit 24. In one possible embodiment, the battery 52 may be a non-rechargeable six volt battery, with a capacity of two hundred twenty-five milliamps. An interactive system 18 that is more engaging may require a longer lasting battery, multiple power supplies, or a rechargeable unit.

The integrated circuit 18 may be connected to actuators 42. The actuators 42 may be, but are not limited to, a tact switch, toggle switch, a paddle switch, a slide and push switch, a DIP switch, a membrane switch which includes a push button, a biased switch, a rotary switch, a reed switch, an illuminated switch, or a micro-switch that is responsive to movement. A preferred embodiment of push button actuators may be a length of four millimeters such that the buttons maintain a low profile on the article of footwear. Push buttons may range from a mini to sub-miniature pushbutton switch, or to smaller sizes such as an ultra miniature micro tact switch. The actuation force required to push and activate the actuator 42 may be in the range of one-hundred to six-hundred gram-force. The actuators may be housed in stainless steel housing, and may be recessed or flush with the housing or have a stem size between half a millimeter to twenty millimeters. The connections between the integrated circuit 24 and the actuators 42 may be through wires 36 or a wireless connection. One actuator 42 may control the power through the battery 52 to the entire or a part of the integrated circuit 24. In the alternate, the power may be turned on by the movement of the article of footwear that is ordinary to the ordinary movements of the foot. Other actuators 42 may activate other features of the interactive system 18 such as activating lights, sounds, vibrations, digitally stored programs or combination of each.

The integrated circuit 24 is connected to one or more speakers 44. In the present example, there may be one speaker 44 that may have a full range of drivers or separate drivers in order to achieve a higher quality of sound. One preferred embodiment may have a round "mini" or "micro" speaker with frequencies that may cover 600 Hz-20 kHz. The speaker may have a plastic casing or other rigid materials that cover one planar face and sides of the speaker which may be used to amplify the sound. The plastic casing may provide a space between the encased speaker and surrounding material so as not to muffle the sound (not shown). Preferred sound frequencies for embodiments that employ smaller speakers are sets of sounds in the higher frequency ranges. The integrated circuit may also have an actuator dedicated for turning the sound on or off, i.e. the sound button 46.

The integrated circuit 24 may be connected to one or more lights. In the present embodiment, the lights may be light emitting diodes 48 (LEDs). Preferred lights are light sources that may withstand applied physical shock that is commonly exerted on footwear. The LEDs 48 may comprise a variety of semiconductor materials for emitting a variety of colors. The LEDs 48 may be housed in separate optical components (e.g. plastic lenses) or combined into one optical component. The LEDs 48 may have varying shaped and sized optical components. When an LED 48 is combined with an actuator 42, such as a push button, the LED 48 may have no optical component. An actuator 42 may be configured with a sealed or non-sealed illuminating switch such that the actuator itself lights up from the application of the actuation force. The light may be an LED 48. In such an embodiment, the materials of the push button may provide sufficient refraction of the light. The LEDs 48 may be configured to flash by employing an integrated multivibrator circuit (not shown). Alternatively, the light source may be a liquid crystal display (LCD). An actuator 42 may be dedicated to turn off and on the activation of all lights while other components of the interactive system 18 are still operable.

The actuators 42 may be housed in materials with a soft tactile feel such as rubber, foam, soft plastics, thermoplastic urethane (TPU), silicone or equivalent materials. The push buttons for the actuators 42 may have greater softness with a greater planar surface area. An LED 48 may be placed adjacent to an actuator 42 and encompassed within the same housing material wherein the housing material acts both as a push button and refractive optical component. Refractive materials may include translucent plastics such as polyethylene (PET), polyvinyl chloride, or thermoplastics. The plastics may contain dyes used for enhancing color. The LED 48 and actuator 42 may be located within an approximate one millimeter distance from each other. An LED 48 may be secured near an actuator 42 on a printed circuit board (PCB) 84.

The integrated circuit 24 may be connected to one or more small electric motors (not shown). The small electric motor is commonly connected to one or more rotating eccentric weights to produce vibration (not shown). The motor may be connected to a gear that interacts with the weight. The gears or weights used with the small electric motor may have different shapes and mass thereby producing varying vibrational wave patterns.

The integrated circuit 24 may be connected to a power supply that obtains energy in part or entirely from a vibration powered generator (not shown). A vibration powered generator is a transducer that converts kinetic energy derived from ambient vibrations into electrical energy. Movement of footwear would produce the vibrational energy needed to make the electrical energy. The produced electrical energy may be stored in a battery 52 or be used to power components of the integrated circuit 24.

Figure 4C:
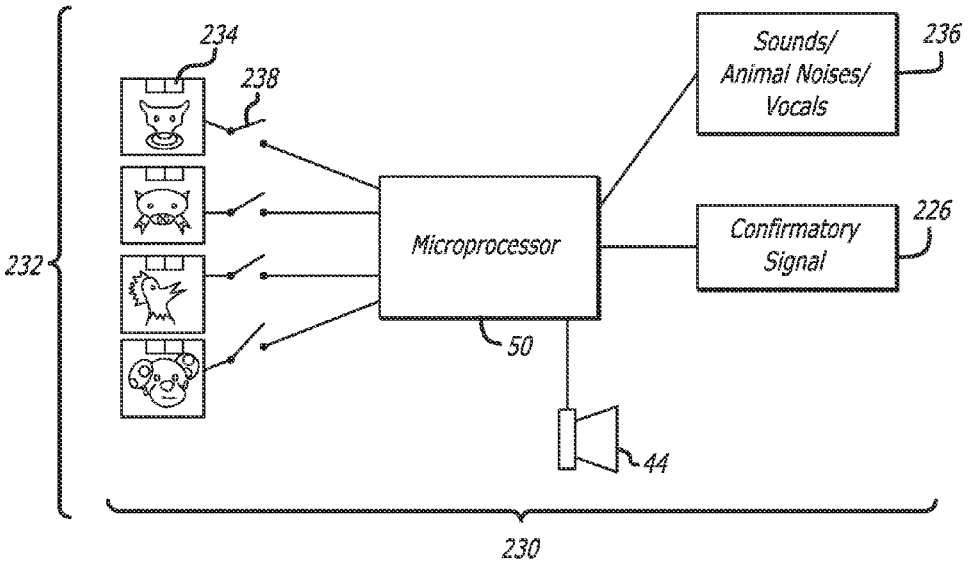
FIG. 4.*a-c* are schematics of exemplary interactive activities that may be used for the interactive system.

The integrated circuit 24 may be connected to a microprocessor 50. The microprocessor 50 may be digitally programmed to initiate discrete sequences of a display of lights, sounds, or vibrations. The microprocessor 50 may also be programmed with one or more interactive activity programs. Alternatively, a discrete circuit, such as a microcontroller, maybe used in place of a microprocessor. The interactive activity may provide entertainment or tutorial sessions wherein the interactive activity is configured to be a musical instrument, a game, or an educational tool. Example schematics of the interactive activities are shown in FIG. 4.*a-c*.

Example Interactive Activity 1

The exemplary activity may be operating a digital musical instrument 200. A user may play music through a series of buttons 202 or equivalent means of input wherein each button is programmed into the microprocessor 50 to specific musical notes or sounds 250. The musical sounds may comprise different musical instruments, human or animal voices, or any other types of sources of sounds at varying auditory frequencies that are heard from the speaker 44. A switch 204 may allow the sounds to be of different musical instruments such as piano, violin, or drums. Each note when selected by the microprocessor 50 may activate a corresponding light 206. The user may create or play a musical arrangement. The microprocessor 50 may also have a program that provides the user a tutorial mode 208 in playing a song. The song may be selected randomly from a group of stored songs 210. The tutorial mode 208 may provide a tutorial output 212 that instructs the user to play one or more notes/sounds 250. The tutorial output 212 may signal the user in the form of sounds, lights, vibrations or a combination of each type of signal. The user would then press a button or series of buttons. The microprocessor 50 may signal the user with one or more signals for subsequent notes. When the user is playing at least one note or sound, the microprocessor 50 may produce a secondary output that provides a confirmatory response 214 as to whether the user's response was correct. The confirmatory response 214 may be in the form of sounds, music, lights, vibration or a combination thereof. Specialized speakers, lights, or vibration generating motors also may be used for the confirmatory response 214 (not shown).

Example Interactive Activity 2

An exemplary activity may be of a game 216. The game 216, when activated, instructs a user to locate one or more targets 218 by providing the user one or more signals of the intended target. Each target 218 has an actuator 42 which may be a push button. Each target 218 may have distinct ornamentation 220 such as a color, pictures, symbols, or words. The signal 242 may be in the form of lights, sounds, music, vibrations, or a combination of signal types. Lights 222 may be embedded in ornamentation such as color, pictures, symbols or words. The signal may be coupled with vibration generating motors 224. The sounds or signals 236, as heard through the speaker 44, may be the type of sound commonly associated with the target. The sounds, lights, vibrations or combination of each type of signal may be descriptive of one or more targets. The one or more targets 218 may be randomly selected by the microprocessor 50 in which the microprocessor 50 stores in its memory the corresponding signals. Upon the user selecting a target 218, the microprocessor 50 may produce a secondary signal which may serve as a confirmatory signal 226 that indicates whether the user's response was correct based on the nature of operation of the user's response. The confirmatory signal 226 may be in the form of sounds, lights, vibrations or a combination of signal types. Specialized speakers, lights, or vibration generating motors may be used for the confirmatory signal 226 (not shown). In the alternate, the microprocessor 50 may instruct the user to find one or more subsequent targets after the first signal, and may continue to provide additional instruction until either a select number of targets have been correctly selected by the user or until the user selects the incorrect target.

Example Interactive Activity 3

Another exemplary activity comprises an educational lesson 230 that may be in the form of a game. The lesson 230 which is programmed into the microprocessor 50 may require a user to find a letter, spell a word, identify an object or animal, add numbers, or pair one or more facts to another.

Assuming for the present embodiment the user was instructed to identify an animal 232, the microprocessor 50 would signal the user to find one or more animals 232. The signal may be one or more lights 234 associated with a picture or from one or more stored sounds, animal noises or vocals 236 which may be emitted by the speaker 44. In response, the user may locate the button 238 associated with at least one or more animals 232. Upon the user selecting a target, the microprocessor 50 may produce a secondary signal as a confirmatory signal 240 that indicates whether the user's response was correct. The confirmatory signal 240 may be in the form of sounds, lights, vibrations or a combination of signal types. Specialized speakers, lights, or vibration generating motors may be used for the confirmatory signal 240 (not shown). In the alternate, the microprocessor 50 may instruct the user to find one or more subsequent animals 232 until either a predetermined number of animals 232 have been correctly selected or until the user selects an incorrect animal 232.

Figure 5:
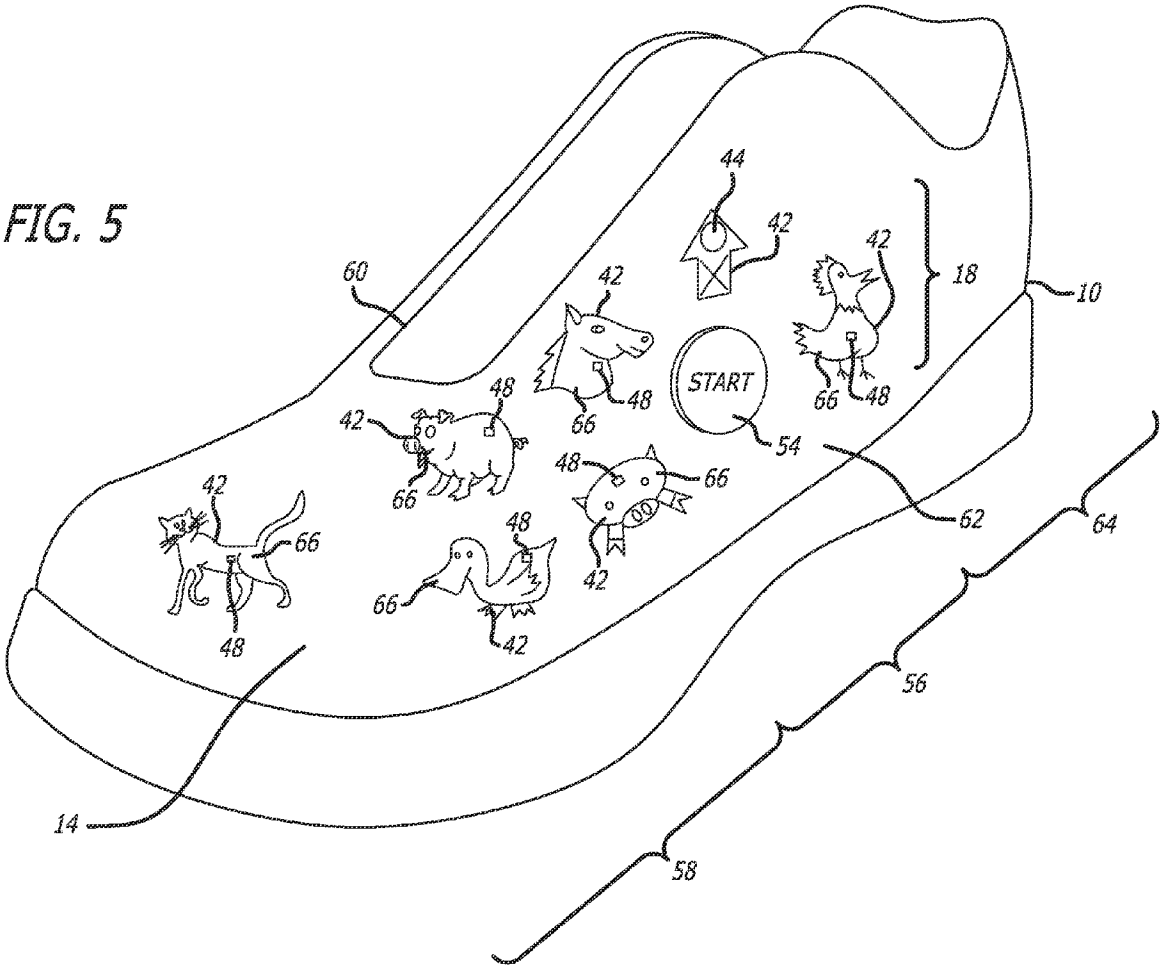
FIG. 5 is a perspective view of one embodiment of an article of footwear with one embodiment of the interactive system.
Figure 6:
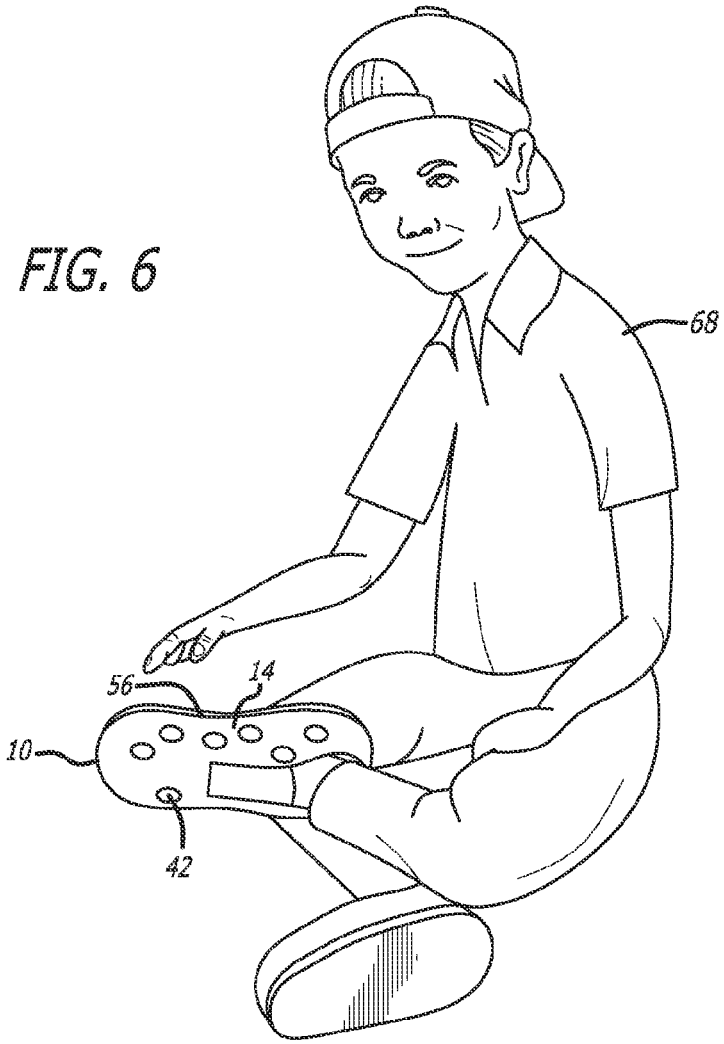
FIG. 6 is a perspective view of a user wearing a shoe and operating the interactive system.

The interactive system 18 may have actuators, lights, speakers, and vibration generating motors that are placed on the upper 14. The interactive system 18 may be operated while the shoe is either stationary or in motion. Referring by way of example to Interactive Activity 3, FIG. 5 shows an exemplary embodiment of an interactive system 18 that teaches identification of animals. A start button 54 of the interactive system 18 is located on the medial area 56 of the upper 14. The location of actuators 42 may be present at any place of the upper. The medial area 56 is an example of an easily accessible area to an actuator 42 for a user who is also wearing the shoe 10 as shown in FIG. 6. The user 68 may sit cross-legged so that the medial area 56 of the upper 14 is accessible. As shown in FIG. 5, other accessible areas may include the toebox 58, lateral area of the upper 60, quarter 62, and heel area 64. When the start button 54 is pressed, the microprocessor randomly selects from a set of digitally stored one or more animal sounds and the corresponding animal actuators 42 which are to be pressed by the user. The animal actuators may be housed in animal buttons 66. The animal buttons 66 may be located as close as one millimeter from each other. The microprocessor plays the selected one or more animal sounds which is emitted from the speaker 44. The animal sounds indicate to the user which animal buttons 66 should be pressed. Each animal button 66 may have an associated LED 48 which may be used in combination with the animal sounds as an indicator of which animal button 66 to press. The associated animal button 66 may be located within 1 mm to its LED 48. The associated LEDs 48 may also be used as a confirmation that the correct animal button 66 was pressed.

Upon the user pressing one or more of the animal buttons 66, the microprocessor may initiate a confirmatory response by activating one or more LEDs 48 and initiating one or more digitally stored sounds that are emitted from the speaker 44. LEDs 48 may be configured as close as one millimeter from each other. In the alternate, following a user's response to the first instruction, the microprocessor 50 may make another selection of one or more animal sounds and emit the sounds from the speaker 44 thereby indicating to the user to select and press another one or more animal buttons 66. The time for the user to respond to the microprocessor's instruction may be increasingly shorter for each subsequent round. After a discrete number of rounds with correct responses by the user, the microprocessor, after gauging the responses, may initiate a reward response in the form of lights, sounds, vibrations or a combination thereof. The response may also indicate that the responses were incorrect or that the user attempts another try in operating the device correctly.

Figure 7:
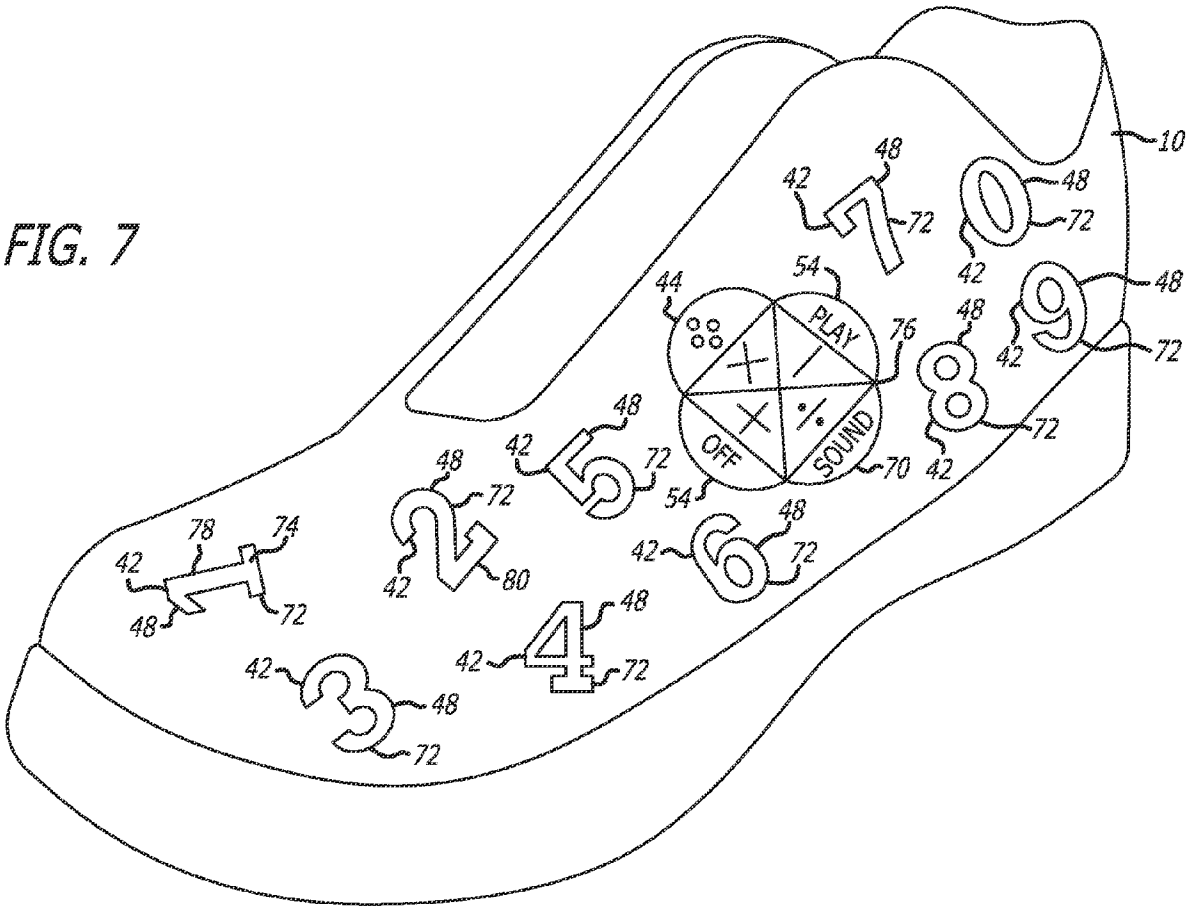
FIG. 7 is a perspective view of an alternate embodiment of the interactive system.

In an alternative embodiment as shown in FIG. 7, the shoe 10 may also have a muting button 70 in which sounds or music are turned off. Such a switch may also be used for systems that include vibration generating motors (not shown). In this present embodiment, LEDs 48 would be used to instruct a user to push a particular button. A particular LED 48 may be associated with at least one actuator 42 and may be positioned within one millimeter from the at least one actuator 42. In the alternate, the microprocessor may also activate two LEDs 48 that are associated with numbers as identified by numeric ornamentations 74. The numeric ornamentations 74 are placed in close proximity or as housing to the LEDs 48. Such housing may also serve as a push button for an actuator 42. The user would then be required to calculate a mathematical function using the two identified numbers. For an addition function, the user may be instructed to press the number buttons 72 that correspond to the sum of the additive function. A correct response will initiate a reward response stored within the microprocessor. An additional actuator may be dedicated to a mathematical switch function button 76 which may switch the interactive activity from addition to subtraction or other multiplicative functions.

If the answer to the mathematical function is larger than a single digit, the microprocessor may be programmed to accept the input of more than one integer number as the final answer. For example, the interactive activity program signals a math problem that requires the user to add four and eight. A correct user response to this example would require the user to press the "one" button 78 and the "two" button 80 in this particular order in order to input the answer "twelve." Following the user's response, the microprocessor may evaluate the user's answer, the number of correct answers from prior rounds, and how long it took the user to answer measured from the time the program signaled the addition problem. The microprocessor may then initiate the emission of a confirmatory response by lights, sounds, vibrations or a combination thereof.

Assembly of the Upper

Figure 8:
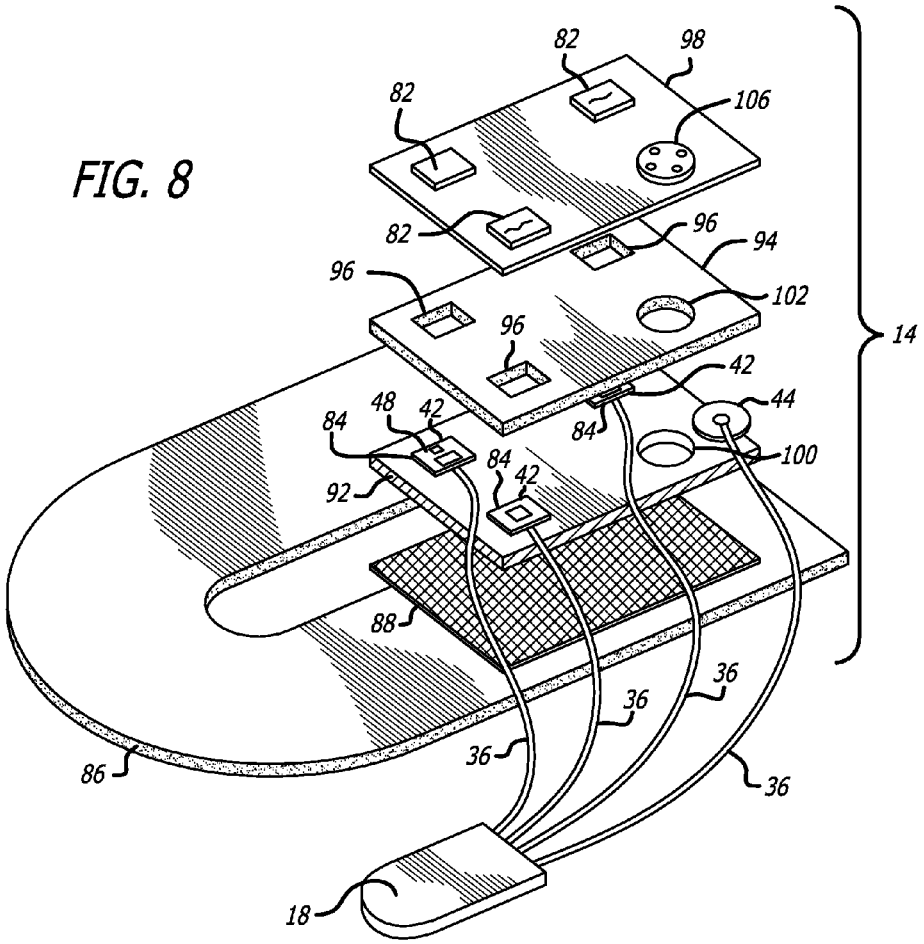
FIG. 8 is a perspective exploded view of an exemplary embodiment of assembly of the interactive system controls and signals.

The interactive system 18 may also be integrated into other footwear other than shoes such as sandals or slippers. The footwear may be further constructed to provide sufficient stability and support for easy use of the actuators 42 and comfort and protection of the foot from components of the interactive system 18 and the user's operation of the said components. In FIG. 8, the exemplary embodiment shows an exploded view of how push buttons 82 may be configured on the upper 14 of a shoe.

An upper 14 may comprise a base 86 made of materials such as foam which are capable of absorbing pressure from the pressing of push buttons 82. The base 86 may have textiles on its interior surface that faces a void capable of receiving a foot. The base 86 may be of a foam material using such materials as EVA, PU, or polyester (PE). The base 86 may be laminated with another layer made of synthetic backing fabric made of, but not limited to, PE. In the regions where the push buttons or other components (e.g. speakers, LEDs, PCBs, or vibration generating motors) of the interactive system may be located, a rigid member 88 may be adhered to these locations to provide sufficient force to allow for user's compression of the push buttons 82. The rigid member 88 may be constructed of water resistant materials or non-conducting materials. The rigid member 88 should be nonporous to allow sound or other waves of energy to bounce off the rigid member 88. The rigid member 88 may be acoustically reflective. The material may be of a semi-hard compressed material and may further be flexible enough when used in locations of the upper wherein the upper must conform to the shape of the shoe. The material may be, but not limited to, a thermoplastic polymer.

An additional pressure absorbing material, absorbing layer 92, may be configured to fit over the rigid member 88. The absorbing layer 92 may be made of, but not limited to, rubber, foam, EVA, or neoprene. The absorbing layer 92 may be non-conductive. In one preferred embodiment, the absorbing layer may have a thickness of one and half millimeter. The wires 36 and push buttons 82 may be laid over the absorbing layer 92. The wires 36 and push buttons 82 may be held in place by adhesives on the absorbing layer 92. The wires may also be secured by stitches or threaded or channeled through the absorbing layer 92. In the present embodiment, an additional cushioning frame 94 with apertures 96 may further stabilize the push buttons 82. The cushioning frame 94 is placed over the absorbing layer 92, and the apertures 96 are configured to fit around the actuators 42 or other components of the interactive system 18. The cushioning frame 94 may be attached to the absorbing layer 92 and the wires 36. In the alternate, the wires 36 may be threaded or channeled through the cushioning frame 94. In one preferred embodiment, the cushioning frame may be constructed of a one and half millimeter thick non-woven material or any other equivalent material. Such material may be of a polypropylene or PE based material. A cushioning frame 94 may provide additional space between the speaker 44 and an outer exterior layer 98.

The exterior layer 98 surrounding the push buttons 82 may be of a polymer or textile material. The material may be water resistant or primed with water resistant dye. The polymer may be thermoplastic material such as TPU. The thermoplastic material may be pre-molded using a microinjection mold. The exterior layer 98 may also include in its mold the push buttons 82 or outer cover 106 of the speaker 44. The outer cover 106 of the speaker may have a plurality of apertures. The outer cover 106 may be configured wherein a void of space exists between the interior surface of the outer cover 106 and the exterior surface of the speaker 44. The exterior layer 98 may be attached to the cushioning frame 94 by adhesives or stitching. In the alternate, a thermoplastic film may be used between the cushioning frame 94 and the push buttons 82.

In the preferred embodiment, the wires 36 of the speaker 44 may be positioned between the absorbing layer 92 and the cushioning frame 94 or within either of the two elements. An aperture 102 of the cushioning frame 94 may be configured to fit around the speaker 44 and hold the speaker in place 44. The thickness of the cushioning frame 94 may be equivalent or more than the thickness of the non-planar portion of the speaker 44. The aperture 102 may allow greater clarity of sound from the speaker 44. The absorbing layer 92 may also have an aperture 100 where the shape of the aperture 100 conforms to the planar dimensions and thickness of the speaker 44, and alternatively may hold the speaker 44 in place. When the speaker is held in place by the absorbing layer 92, the aperture 100 may allow the speaker 44 to have sufficient space away from the exterior layer 98 so that the sound may be amplified.

The exterior layer 98 may have a plurality of apertures for allowing sound to clearly emanate from the speaker 44. The exterior layer 98 may be molded such that the exterior layer does not make direct contact with the outwardly facing side of the speaker 44. A fibrous or mesh material may be used between the exterior layer 98 and the speaker 44 (not shown). The fibrous or mesh material may be of a water resistant material. Such materials include but are not limited to synthetic polymers, acrylic, polyamide, nylon, PET, polypropylene, and PE. A water resistant primer may be used on the material. A preferred mesh may include, but is not limited to, materials that are either one-hundred fifty to three-hundred grams per each square yard. Thinner mesh materials may minimize loss of sound while still protecting the speaker from water. Larger pore diameter size may also minimize loss of sound. However, smaller pore diameter size may decrease the water exposure on the speaker 44.

The LEDs 48 may be individually positioned at various locations of the upper. An LED 48 may also be positioned adjacent to an actuator 42 at distances as close as one millimeter on a PCB 84 or equivalent material. The exterior layer 98 may be constructed out of translucent materials with or without dyes which are positioned over the LEDs 48. The exterior layer 98 may be constructed with microinjected thermoplastic polyurethane or other equivalent materials.

The exterior layer 98 may be comprised of other materials ordinarily used on the exterior of uppers and such materials may be used in areas that are not comprised of the interactive system. In the alternate, the assembly as shown in FIG. 8 may be adapted to other articles of footwear such as, but not limited to, boots or sandals.

While the specification describes particular embodiments of the present invention, those of ordinary skill can devise variations of the present invention without departing from the inventive concept.

We claim:

1. An article of footwear comprising:

a) a signal system having a plurality of indicators wherein at least one of the indicators produces a signaling event of one or more signals wherein the one or more signals instructs a user of the system to engage through a response system;

b) said response system having a plurality of activators, and whereby one or more activators corresponds to one or more signals that instructs the user;

c) said plurality of activators being controlled by the user wherein such control is executed through actions that are not associated with the user's compression of a sole of the article of footwear;

d) whereby during said signaling event, said signal system communicates to the response system which one or more activators corresponds to the one or more signals produced by the at least one of the indicators;

e) so that when said one or more activators are engaged by the user and the users engagement is in conformity with the one or more signals' instructions, the response system communicates to the signal system that the users engagement was in conformity with the one or more signals' instructions;

f) whereby the user's conforming engagement of the one or more activators initiates an additional signaling event whereby the additional signaling event further instructs the user to engage said one or more corresponding activators;

g) said signal system having a specified number of signaling events and said signal system operative to count the number of signaling events so that after the signal system reaches the specified number of signaling events, the signal system provides a confirmatory signal that indicates whether the user engagements were in conformity with each signaling event's instructions.

2. The article of footwear of claim 1 wherein at least one of said indicators emits a wave of light, sound, or vibration, or a combination of either of these waves.

3. The article of footwear of claim 1 wherein at least one of the indicators is operable to be selectively turned off or on.

4. The article of footwear of claim 1 wherein said article of footwear has a sole, an insole, and an upper; and said sole has an integrated circuit; said integrated circuit comprising a battery and a microprocessor and a plurality of wires; said plurality of wires being connected to at least one of said indicators and to at least one of said activators.

5. The article of footwear of claim 4 having in at least some portion thereof of the upper, a base layer, a rigid layer, and an outer layer; said rigid layer being positioned over said base layer; a cushioning layer positioned over said rigid layer; said plurality of wires positioned against said cushioning layer; and said cushioning layer having at least one aperture configured to hold at least one of said indicators and said activators.

6. The article of footwear of claim 5 further having an absorbing layer, and said absorbing layer being positioned between said cushioning layer and said rigid layer.

7. The article of footwear of claim 6 wherein at least one of said indicators includes a speaker and the absorbing layer has an aperture that fits snuggly around the speaker.

8. An article of footwear into which an interactive activity is integrated comprising:

a) a plurality of inputs wherein a user of the interactive activity operates the plurality of inputs;

b) a plurality of outputs wherein said outputs are responsive to the user's operation of at least one of the inputs and wherein said outputs emit radiating waves of energy and at least one or more of said outputs provides the user with instructions to operate at least one of said inputs;

c) an evaluation system being responsive to said user's operation of at least one or more said inputs wherein said evaluation system evaluates the nature of operation of said inputs by the user of the interactive activity;

d) a plurality of confirmatory signals being responsive to said evaluation system wherein the confirmatory signals indicate the propriety of said nature of operation; and e) an upper wherein the upper has at least three layers of materials and said one or more inputs and said one or more outputs are positioned within at least three layers of materials, wherein said three layers of materials provide comfort in wearing the shoe while the user operates said one or more inputs that are connected to the upper.

9. The article of footwear of claim 8 wherein said inputs are operated by the user through actions that are not associated with the user's compression of a sole of the article of footwear.

10. The article of footwear of claim 8 wherein said evaluation system comprises an integrated circuit that evaluates how many times the user operates said inputs, which inputs were operated by the user, and how much time has passed starting from the time when said at least one or more outputs were emitted.

11. The article of footwear of claim 8 wherein said at least three layers of materials comprising a first layer that is substantially of a pressure absorbing material and a second layer that is substantially of a rigid material.

12. An article of footwear comprising:

a) an upper having a plurality of input areas and a plurality of output areas;

b) wherein said plurality of input areas are accessible by a user when the shoe is either in motion or stationary;

c) wherein each input area is separated by at least one millimeter from each other;

d) wherein each output area is separated by at least one millimeter from each other;

e) wherein at least one input area is connected to an associated output area;

f) wherein at least one output area and the associated input area are not separated by more than one millimeter;

g) wherein each output area directs the user to provide input to one or more of said input areas, or produces a signal that indicates the propriety of the user's input.

13. The article of footwear of claim 12 wherein the at least one input area and at least one output area are used to play an interactive activity whereby the user manually presses the at least one input area in accordance with the instructions provided by the at least one output area.

14. The article of footwear of claim 12 wherein the at least one input area and at least one output area are used to provide a music tutorial whereby the user manually presses the at least one input area in accordance with the instructions provided by the at least one output area, and whereby the at least one output area emits a sound.

15. The article of footwear of claim 12 wherein the at least one input area and at least one output area are used to provide an educational session whereby the user manually presses the at least one input area in accordance with the instructions provided by the at least one output area, wherein the at least one output area emits a signal that conveys information.

16. The article of footwear of claim 12 wherein the at least one input area is attached to the upper.

17. The article of footwear of claim 12 wherein the at least one output area is attached to the upper.

18. The article of footwear of claim 12 wherein the at least one output area emits a wave of light, sound, or vibration, or a combination thereof.

* * * * *